US010389049B2

(12) United States Patent
Stromiedel et al.

(10) Patent No.: US 10,389,049 B2
(45) Date of Patent: Aug. 20, 2019

(54) CONDUCTOR TERMINAL AND SET FORMED OF THE CONDUCTOR TERMINAL AND AN ACTUATION TOOL

(71) Applicant: WAGO Verwaltungsgesellschaft mbH, Minden (DE)

(72) Inventors: Konrad Stromiedel, Wolkramshausen (DE); Henry Stolze, Bad Frankenhausen (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 16/004,841

(22) Filed: Jun. 11, 2018

(65) Prior Publication Data

US 2018/0294584 A1 Oct. 11, 2018

Related U.S. Application Data

(63) Continuation of application No. PCT/EP2016/078543, filed on Nov. 23, 2016.

(30) Foreign Application Priority Data

Dec. 11, 2015 (DE) ..... 10 2015 121 638

(51) Int. Cl.
*H01R 12/51* (2011.01)
*H01R 4/48* (2006.01)
(Continued)

(52) U.S. Cl.
CPC ..... *H01R 12/515* (2013.01); *H01R 4/4836* (2013.01); *H01R 12/53* (2013.01); *H01R 12/57* (2013.01); *H01R 13/506* (2013.01)

(58) Field of Classification Search
CPC ..... H01R 12/53; H01R 12/57; H01R 12/515; H01R 4/4836; H01R 13/506
(Continued)

(56) References Cited

U.S. PATENT DOCUMENTS 3,512,121 A * 5/1970 Bergeron ..... H01R 9/24 264/249
6,287,130 B1 9/2001 Torii
(Continued)

FOREIGN PATENT DOCUMENTS

AT 14381 U1 10/2015
DE 102010014144 A1 10/2011
(Continued)

OTHER PUBLICATIONS

International Search Report dated Feb. 7, 2017 in corresponding application PCT/EP2016/078543.
(Continued)

*Primary Examiner* — Harshad C Patel
(74) *Attorney, Agent, or Firm* — Muncy, Geissler, Olds & Lowe, P.C.

(57) ABSTRACT

A conductor terminal with an insulating material housing and a spring-force terminal connection. The spring-force terminal connection has a contact body which is shaped out of a sheet element and has a base portion, lateral wall portions that protrude from the base portion and are mutually spaced, and solder connection contact tongues. The base portion together with the lateral wall portions forms a conductor receiving channel for receiving an electric conductor, and leaf spring tongues protrude from the lateral wall portions so as to face one another, each leaf spring tongue has a clamping edge for clamping an electric conductor received in the conductor receiving channel. The insulating material housing has a conductor insertion opening which leads to the conductor receiving channel on the front face.

19 Claims, 14 Drawing Sheets

(51) Int. Cl.
*H01R 12/53* (2011.01)
*H01R 12/57* (2011.01)
*H01R 13/506* (2006.01)

(58) Field of Classification Search
USPC ..... 439/722
See application file for complete search history.

(56) References Cited

U.S. PATENT DOCUMENTS 7,513,793 B2 * 4/2009 Horst ..... H01R 4/4818 439/427
8,591,271 B2 11/2013 Bies
8,882,533 B2 11/2014 Brandberg et al.
9,444,155 B2 9/2016 Chen et al.
9,553,406 B2 * 1/2017 Wu ..... H01R 4/4836
9,780,488 B2 * 10/2017 Fu ..... H01R 4/4827
9,831,581 B2 * 11/2017 Fu ..... H01R 4/4827
9,859,638 B2 * 1/2018 Fu ..... H01R 4/4827
2011/0250775 A1 * 10/2011 Bies ..... H01R 4/4836 439/296
2014/0024230 A1 * 1/2014 Decker ..... H01R 12/73 439/65

FOREIGN PATENT DOCUMENTS

DE 102015209224 A1 12/2015
KR 20140122904 A 10/2014
WO WO2013176859 A1 11/2013
WO WO2015131215 A1 9/2015

OTHER PUBLICATIONS

International Preliminary Report on Patentability dated Jun. 21, 2018 in corresponding application PCT/EP2016/078543.

* cited by examiner

CONDUCTOR TERMINAL AND SET FORMED OF THE CONDUCTOR TERMINAL AND AN ACTUATION TOOL

This nonprovisional application is a continuation of International Application No. PCT/EP2016/078543, which was filed on Nov. 23, 2016, and which claims priority to German Patent Application No. 10 2015 121 638.8, which was filed in Germany on Dec. 11, 2015, and which are both herein incorporated by reference.

BACKGROUND OF THE INVENTION

Field of the Invention

The present invention relates to a conductor terminal with an insulating material housing and a spring-force terminal connection, which comprises a contact body which is shaped out of a sheet element and which comprises a base portion, lateral wall portions that protrude from the base portion and are mutually spaced, and solder connection contact tongues. Together with the lateral wall portions, the base portion forms a conductor receiving channel for receiving an electric conductor. At least one leaf spring tongue protrudes from the lateral wall portions, which has a clamping edge for clamping an electric conductor received in the conductor receiving channel. The insulating material housing has a conductor insertion opening which leads to the conductor receiving channel on the front face. The invention further relates to an assembly formed of such a conductor terminal and actuating tool.

Description of the Background Art

Conductor terminals, for example, with a pusher integrated in the insulating material housing, are known from DE 10 2010 014 144 B4, which corresponds to U.S. Pat. No. 8,591,271, which is incorporated herein by reference.

WO 2013/176859 A1, which corresponds to U.S. Pat. No. 8,882,533, discloses an SMD PCB terminal with actuating slides protruding from the upper surface of the insulating material housing for opening a clamping point formed on the respective spring-force terminal connection for clamping an electric conductor.

KR 10 2014 0122904 A describes a similar SMD PCB terminal with a spring-force terminal connection with two mutually facing leaf springs which have actuating tabs facing in the conductor insertion direction, and an insulating material housing with an actuating slide displaceably inserted into an opening in the top and back.

SUMMARY OF THE INVENTION

It is therefore an object of the present invention to provide an improved conductor terminal, in which the handling in automatic assembly machines is improved and the visibility of the conductor terminal is reduced when used in a lighting device.

In an exemplary embodiment for a conductor terminal, it is provided that the soldered connection contact tongues are bent out of the plane of the base portion, define a solder connection plane which is offset to the plane of the base portion, and form an indented region of the base portion. A closure cover is provided for latching into the indented region.

First of all, a reduction in the overall height of an electric circuit board provided with the conductor terminal is achieved by bending the solder connection contact tongues out of the plane of the base portion in such a way, that the contact tongues define a solder connection plane which is offset to the plane of the base portion. This way, the conductor terminals may be hooked into an opening of the printed circuit board and soldered to the back of the circuit board.

The conductor terminal is thus not simply placed on a printed circuit board and soldered to solder connection contacts at the top surface. This plane offset also creates an indented region of the contact body into which a closure cover can be latched. With this closure cover, a suction surface for an automatic assembly machine for handling the conductor terminal is provided. In addition, light traps or dark spots are prevented from forming when light-emitting elements (e.g., light emitting diodes LEDs), which are mounted on the circuit board, are situated on the side of the solder connection contacts. Depending on the arrangement of such light-emitting elements as well as the formation of a diffusing plate, the recesses may be perceived by a diffusing plate as "dark spots" within the conductor terminal. With a closure lid, the visibility of the conductor terminal arranged adjacent to the light-emitting elements is reduced.

The closure cover constitutes a separate part from the insulating material housing, the cover being connected to the contact body and achieving its function even without the insulating material housing.

The closure cover may have latching tabs that are adapted for latching into latching openings in the contact body. It is also conceivable that the closure cover has latching openings or latching edges which are adapted to interlock with latching tabs of the contact body.

By means of this interlocking of the closure cover with the contact body, latching openings are prevented on the insulating material housing which could reduce the clearance and creepage distance.

The closure cover can have fingers which protrude perpendicularly or substantially perpendicularly from a cover plate of the closure cover. In each case, a pair of such fingers is then disposed mutually opposite at a distance from each other, and is adapted for immersing in the indented region to bear in each case against a connecting web of the contact body leading from the base portion to a solder connection contact tongue. In this way, the closure cover is latched with a respective pair of such opposing fingers on mutually opposite connecting webs with latching elements of a pair of such fingers facing away from one another. While the cover plate remains above the plane defined by the solder connection contact tongues, the fingers dip into the indented region of the contact body.

The fingers may each have a depression with a latching edge. The depressions are then respectively formed for receiving a latching tab of the contact body. Such a latching tab may protrude, e.g., from a connecting web. The latching edge is formed by a boundary wall of the depression.

Such a depression in a finger can improve the strength and stiffness of the finger. The lateral walls, which define the depression, increase the resistance of the finger against elastic deformation in case of force application and bending stress.

However, the fingers may also each have a latching tab, which is designed to latch into a latching opening of a respective adjacent connecting web of the contact body.

Between two adjacent fingers of the closure cover, covering tongues of the cover plate can protrude on the plane of the cover plate. The covering tongues can remain free of the portions of the cover plate which transition into the fingers by means of slots. By means of the slots, the clearance and creepage distances are improved, in particular when the insulating material housing dips into these slots.

The cover portion of the insulating material housing situated opposite the base portion can be fully closed towards the top, on the side of the spring-force terminal connection facing away from the base portion, in the region adjacent to the lateral wall portions and the at least one leaf spring tongue of the contact body. In this case, on the back side which is opposite the conductor insertion opening, the insulating material housing may have an actuating opening leading to actuating tabs of at least one leaf spring tongue. The actuating opening is thereby bounded by the cover portion of the insulating material housing to form a guide channel.

Thus, the cover portion which is adjacent to the at least one actuating tab above the spring of the spring-force terminal connection constitutes a guide wall of a guide channel, against which an actuating tool or an actuating tool plugged into the actuating opening or an actuating element slidably installed in the actuating opening is guided. The actuation is then carried out exclusively via the actuating opening accessible from the back side so that the actuating forces act only as shear forces on the solder terminal contacts of the conductor terminal.

Due to the fact that the cover portion, which is adjacent to the spring-force terminal connection, is closed on the side of the spring-force terminal connection facing away from the base portion, the at least one leaf spring tongue can only be opened by an actuating force that is oriented counter to the conductor insertion direction from the back actuating opening in the direction of the front-side conductor insertion opening. A force component acting from the cover portion towards the base portion is avoided, so that the forces acting on the solder joints of the conductor terminal do not affect the solder joints.

The guide channel of the actuating opening may be formed not only by the cover portion, but also by spaced, lateral interior wall portions of the insulating material housing and a socket portion situated opposite the cover portion. Thus, the guide channel is bounded by wall portions on one side, both sides or optionally on all sides or circumferentially. A separate actuating tool is optimally guided to the at least one actuating tab. Optionally, an actuating element can also be fitted in such a guide channel, which is then mounted so that it slides in the actuating direction from the front to the back.

The socket portion defining the guide channel in the direction of the base portion may be spaced from the base portion of the spring-force terminal connection to form a conductor receiving pocket. On the one hand, a conductor receiving pocket is thus provided in the conductor insertion direction between the base portion and the socket portion, behind the clamping point formed by the clamping edge of the at least one leaf spring tongue for clamping an electric conductor. In addition, the conductor insertion region or conductor receiving area is defined by the actuating plane, which is situated above the socket portion, into which the respective actuating tab of the at least one leaf spring protrudes. This prevents the actuating opening from being blocked by strands of an electric conductor.

The guide channel may terminate immediately upstream of the at least one actuating tab so that the guide channel is formed by the actuating opening and then transitions into the actuating tab of the leaf spring and the cover portion situated above. In the event of two mutually facing leaf springs, the actuating opening is thus extended by the cover portion and the two mutually spaced actuating tabs. In the cover portion of the insulating material housing, an indentation can be provided in the back region which is situated opposite the conductor insertion opening. This indentation then transitions into the actuating opening leading to the actuating tabs. This indentation has the advantage that a positioning region is provided into which an actuating tool is inserted from the top, obliquely from the back, or directly from the back. Due to the lateral boundary walls of the indentation and the bottom of the indentation, the actuating tool is then positioned such that it can be introduced into the actuating opening which is adjacent to the indentation.

The base portion may have solder connection contacts protruding from the contour of the insulating material housing. These are then provided for soldering to a printed circuit board and can be SMD contacts for a surface solder mounting or pin contacts for a push-through solder mounting.

The actuating opening may be provided to receive a separate actuating tool. However, it is also conceivable that the actuating opening extends from the back to the front through the insulating material housing and emerges on the front side adjacent to the conductor insertion opening. This also facilitates actuation of the front and/or testing of the voltage potential at the spring-force terminal connection at the front side. In this embodiment, it is particularly advantageous when an actuating element is slidably accommodated in the actuating opening. The actuating element can have a protruding actuating portion that is formed to apply force to the at least one actuating tab for opening the clamping point formed by the clamping edges. This protruding actuating portion is located in the interior of the insulating material housing, in the region of the actuating tab of the leaf spring tongue.

The actuating element may have a head portion which is accessible from the back of the insulating material housing for applying force, and a signal portion protruding from the front of the insulating material housing in the open state of the spring-force terminal connection. This signal portion shows whether the clamping point formed at the clamping edge of the leaf spring tongue is open or not. In addition, by applying force to the signal portion towards the rear, the actuating element can be pushed back to the resting position in which the leaf spring tongue is not affected by the actuating element and exerts a resilient clamping force on an electric conductor that is to be inserted and clamped.

The insulating material housing can thus have several juxtaposed conductor insertion openings. The conductor terminal can have several spring-force terminal connections that are juxtaposed in the insulating material housing and assigned to a respective conductor insertion opening and actuating opening.

The invention is further solved by the assembly of conductor terminal and actuating tool, wherein the actuating tool has a holding portion and an actuating finger which is designed for insertion into the actuating opening and for pressing apart the actuating tabs of the clamping point. In this embodiment, a separate actuating tool is provided, which is insertable from the back with its at least one actuating finger into an associated actuating opening of the insulating material housing, to then be guided by the motion of the actuating finger towards the front side of the insulating material housing between the actuating tabs, in order to push these apart.

The holding portion and the actuating finger are thereby preferably at an angle to each other. This angle may preferably be in the range of about 90 degrees+/−20 degrees. The holding portion and the at least one actuating angle are particularly preferably arranged at a right angle to each other.

A plurality of juxtaposed and mutually spaced actuating fingers may be provided on the holding portion for inserting in each case into an associated actuating opening of a plurality of actuating openings of the insulating material housing of the conductor terminal. This results in the simultaneous opening of multiple clamping points of a multi-pole conductor terminal, whereby handling is simplified.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
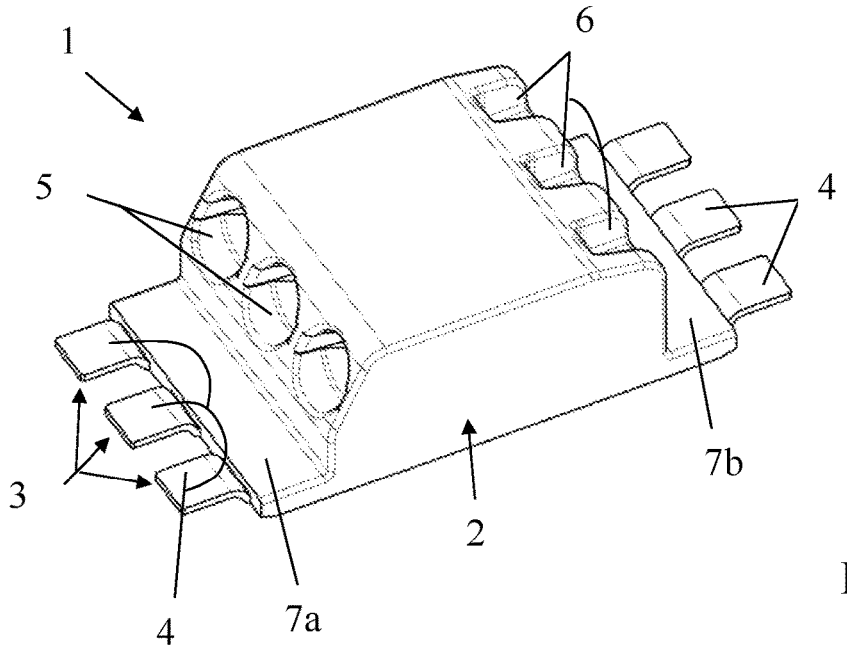
FIG. 1 is a perspective view of an exemplary embodiment of a conductor terminal.

FIG. 1 reveals a perspective view of an exemplary embodiment of a conductor terminal 1, having an insulating material housing 2 and a number of spring-force terminal connections 3 that are built into the insulating material housing 2. Respective solder terminal contacts 4 can be seen protruding from the spring-force terminal connections 3, out of the front and back sides of the insulating material housing 2.

It is clear that the insulating material housing 2 has on its front side conductor insertion openings 5 for feeding a respective electric conductor to a clamping point, which is formed on the respective spring-force terminal connection in the space of the insulating material housing 2.

In the region of the back side of the insulating material housing 2, which is situated opposite the front side with the conductor insertion opening 5, indentations 6 are present in the insulating material housing 2. These indentations 6 transition into actuating openings on the back side, which lead into the interior of the insulating material housing 2.

It is also clear that at the front side, upstream of the conductor insertion openings 5, there is in each case a bottom base 7*a* which is formed as a part of the insulating material housing 2, and at the back side, upstream of the indentations 6, there is a bottom base 7*b* also formed as part of the insulating material housing 2. The former serves to provide support on a printed circuit board when the conductor terminal 1 is inserted into an opening of a printed circuit board and is soldered with the solder terminal contacts 4 ton the back of the circuit board.

Figure 2:
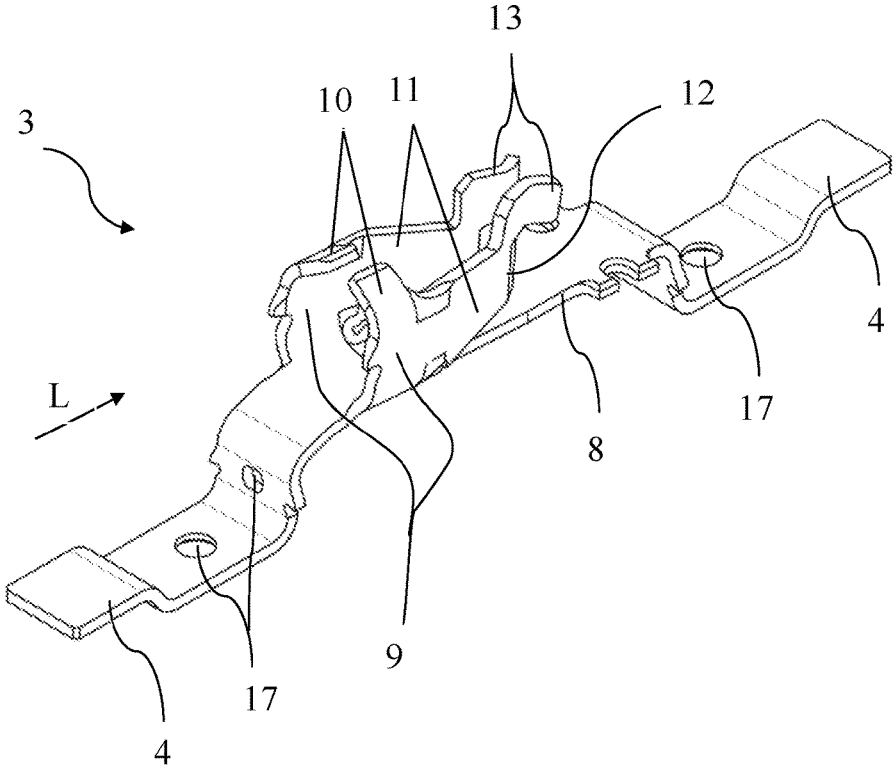
FIG. 2 is a perspective view of the basic construction of the spring-force terminal connection for the conductor terminal from FIG. 1.

FIG. 2 reveals a perspective view of the basic construction of a spring-force terminal connection 3 for the circuit board. It is clear that the spring-force terminal connection 3 is formed in one piece from a sheet element as a stamped and bent part. Here, a base portion 8 is provided, from which two spaced apart lateral wall portions 9 protrude. The lateral wall portions 9 and the base portion 8 form a conductor receiving channel for receiving an electric conductor. The conductor receiving channel may in part be at least partially closed by limiting tabs 10 on the side opposite the base portion 8, which are bent away from the lateral wall portions towards one another. However, the top of the conductor receiving channel can also be closed off by sections of the insulating material housing 2.

It can be seen in the illustrated embodiment, that two leaf spring tongues 11 protrude from the lateral wall portions 9 in the conductor insertion direction L. The leaf spring tongues 11 extend approximately parallel to the base portion 8 and run towards each other. At the ends of the leaf spring tongues 11, in each case clamping edges 12 are formed for clamping an electric conductor or the stripped end thereof. Alternatively, an embodiment with only one leaf spring tongue 11 is conceivable, which, for example, forms a clamping point with a lateral wall portion 9 or a tab protruding therefrom.

It is also clear that actuating tabs 13 protrude from the leaf spring tongues 11 on the upper edges, which are situated opposite the base portion 8. These actuating tabs 13 are obliquely bent out from each other and are provided for receiving an actuating tool or an actuating element. With their free end, they extend in the conductor insertion direction L or in the extension direction of the leaf spring tongues 11 and expand in a funnel shape toward their free end. By means of such an actuating tool or actuating element inserted between the actuating tabs 13, the leaf springs 11 are moved away from one another to open the clamping point formed at the clamping edges 12 and to be able to remove a clamped electric conductor.

It is further clear that the plane of the base portion 8 in the region of the lateral wall portions 9 and the leaf spring tongues 11 is raised or offset to the plane of the solder terminal contacts 4 in order to form in this manner an indentation or a free space on the underside of the spring-force terminal connection 3 situated opposite the leaf spring tongues 11. This way, the conductor plug-in plane formed by the conductor insertion channel for insertion of an electric conductor is arranged relatively far offset of the solder terminal plane which is defined by the solder terminal contacts 4. The depth of the indentation or the free space should at least match the thickness of a conventional printed circuit board, so that the solder terminal plane is situated on the underside of the circuit board and the conductor plug-in plane is located above the top surface of the circuit board.

Figure 3:
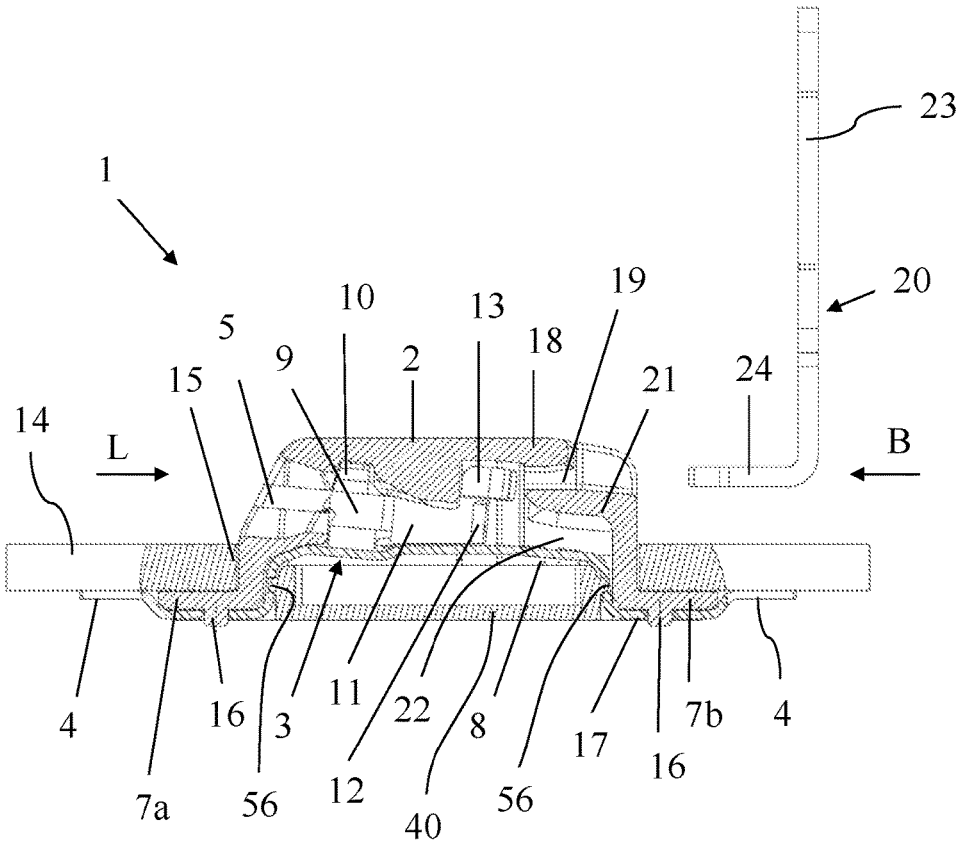
FIG. 3 is a side sectional view of the conductor terminal from FIG. 1 with an additional actuating tool.

FIG. 3 shows a side sectional view of the conductor terminal 1 from FIG. 1. It is clear that the solder terminal contacts 4 are soldered to the back of a printed circuit board 14 when the conductor terminal 1 is inserted into an opening 15 of the circuit board 14. The bottom bases 7*a*, 7*b* of the insulating material housing 2 are supported on the underside of the circuit board 14. The spring-force terminal connections 3 are positionally fixed to the insulating material housing 2 by protrusions 16 of the insulating material housing 2 which protrude through associated support openings 17 of the base portion 8.

It is clear that the plane of the base portion 8 in the interior of the insulating material housing 2, as compared to the plane formed by the solder terminal contacts 4, is displaced toward the cover portion 18 of the insulating material housing 2. The solder terminal contacts 4 are thus moved further downwards so as to allow back side mounting on the circuit board 14.

It is clear that the cover portion 18 above the spring-force terminal connection 3 in the region of the leaf springs 11, and in particular of the actuating tabs 13, is fully closed. The cover portion 18 continues to extend to the back of the insulating material housing 2, which is opposite the conductor insertion opening 5, so as to limit an actuating opening 19 for inserting an actuating tool 20. Opposite the cover portion 18, the actuating opening 19 is limited by a socket portion 21. This socket portion 21 is spaced from the base portion 8 of the spring-force terminal connection 3 to define a conductor collecting pocket 22. An electric conductor guided past the leaf springs 11 by the conductor insertion opening 5 is thus led with its stripped free end through the base section 8 and the socket portion 21 situated above, into the conductor collecting pocket 22. The clearance of the actuating opening 19 situated above the socket portion 21 is thus kept free of any strands of an inserted and clamped electric conductor.

It is further clear that the actuating tabs 13 continue to protrude in the conductor insertion direction L, from the clamping end 12 towards the socket portion 21. If an actuating finger 24 protruding from a holding portion 23 of the actuating tool 20 is now inserted into the actuating opening 19, the finger acts on the opposing actuating tabs 13, pushing them apart on an actuating plane. This actuating plane is situated above the conductor terminal plane, which is formed by the clamping edges 12 and the adjoining conductor collecting bag, and which is limited upwards by the socket portion 21 towards the actuating opening 19.

Opening the clamping point of the spring-force terminal connection 3 is thus effected by an actuating force acting in the direction of the arrow B, opposite the conductor insertion direction L. At most, the actuating force B exerts a shear force on the solder terminal contacts 4. An actuating force acting transversely to the surface of the printed circuit board 14, which could affect the solder joints on the solder terminal contacts 4, is avoided.

Furthermore, it is apparent that from underneath, a housing part in the form of a closure cover 40 is latched into the indented region of the base portion 8. Here, protrusions in the form of latching tabs 56 also latch into latching openings in the sheet material of the base portion 8. With this closure cover 40, a suction surface for an automatic assembly machine for handling the conductor terminal 1 is provided. In addition, it is avoided that a light trap or dark spots form when there are light-emitting elements (e.g., light-emitting diodes LEDs) on the printed circuit board 14 on the side of the solder terminal contact 4. Depending on the arrangement of such light-emitting elements as well as the formation of a diffusing plate, the indentations within the conductor terminal 1 can be perceived as "dark spots" through a diffusing plate.

The closure cover 40 is optional. Without such a closure cover 40, the bottom portion 8 itself may even be used as a suction surface for an automatic assembly machine.

Figure 4:
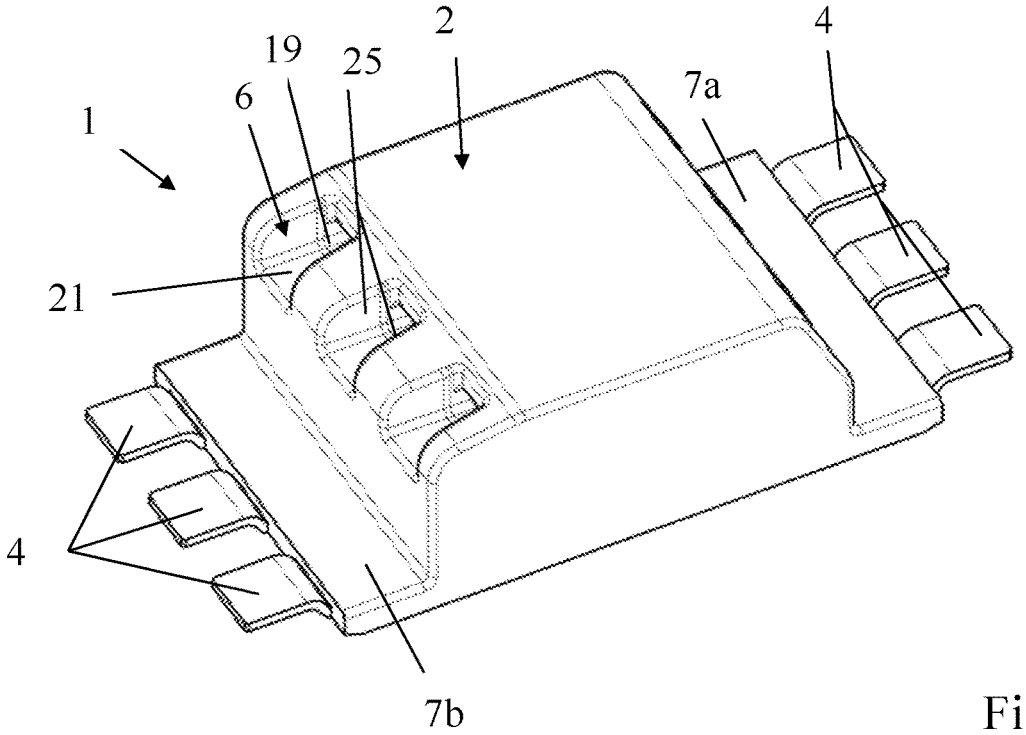
FIG. 4 is a perspective rear side view of the conductor terminal from FIG. 1.

FIG. 4 reveals a perspective rear side view of the conductor terminal 1 from FIGS. 1 and 3. It is clear that the indentations 6 are delimited in each case by the socket portion 21, as the bottom surface, and opposing inner wall faces 25 of the insulating material housing 2. With the aid of these indentations, the insertion of the actuating tool 21 into the actuating indentation 19 is facilitated in that the indentation 6 provides a funnel-shaped lead-in area.

Figure 5:
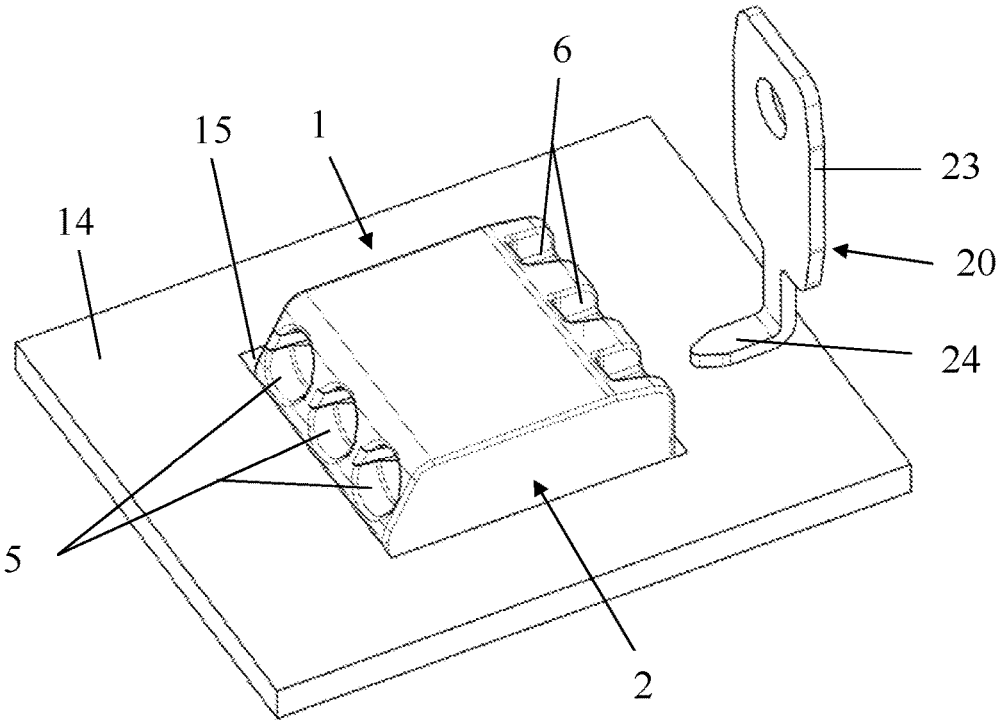
FIG. 5 is a perspective view of the conductor terminal inserted in a printed circuit board with a separate actuating tool.

FIG. 5 reveals a perspective view of the conductor terminal 1 inserted in a printed circuit board 14. It is clear that the circuit board 14 has a rectangular opening into which the conductor terminal 1 is inserted from underneath. However, the conductor insertion opening 5 opens onto the plane of the top of the circuit board 14, or possibly slightly higher. With this type of construction, the height of an electrical device can be reduced as compared to simply soldering a simple conductor terminal 1 to the upper surface of the circuit board 14.

Figure 6:
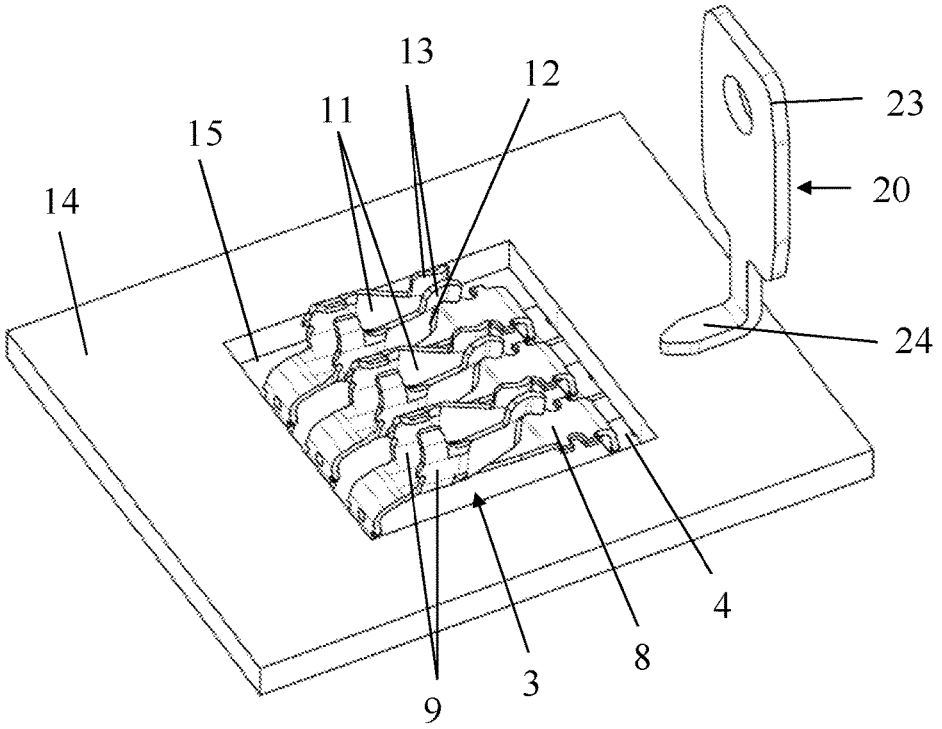
FIG. 6 is a perspective view of the conductor terminal from FIG. 5 without the insulating material housing.

FIG. 6 reveals a perspective view of the conductor terminal 1 from FIG. 5 without an insulating material housing 2. The position of the adjacently arranged plurality of spring-force terminal connections 3 in the receiving opening 15 of the circuit board 14 can be seen. It is clear that in each case actuating tabs 13 protrude from the leaf springs 11 on the upper side, which is located opposite the base portion 8. The tabs extend from the end portions of the leaf spring tongues 11 with the clamping edges 12 beyond the clamping edges 12. A pair of such actuating tabs 13 of a spring-force terminal connection 3 is bent with their free ends from each other to form an insertion funnel for the actuating finger 24 of an actuating tool 20.

In the illustrated resting position, the clamping edges 12 of the leaf springs 11 of a spring-force terminal connection 3 face each other as a result of the spring force of the leaf springs 11. The clamping edges 12 can then abut one another without the clamped electric conductor. If an electric conductor is now guided past the lateral walls 9 and the leaf springs 11 to the clamping edges 12, then the electric conductor is clamped to the spring-force terminal connection 3 by the clamping force of the leaf springs.

Figure 7:
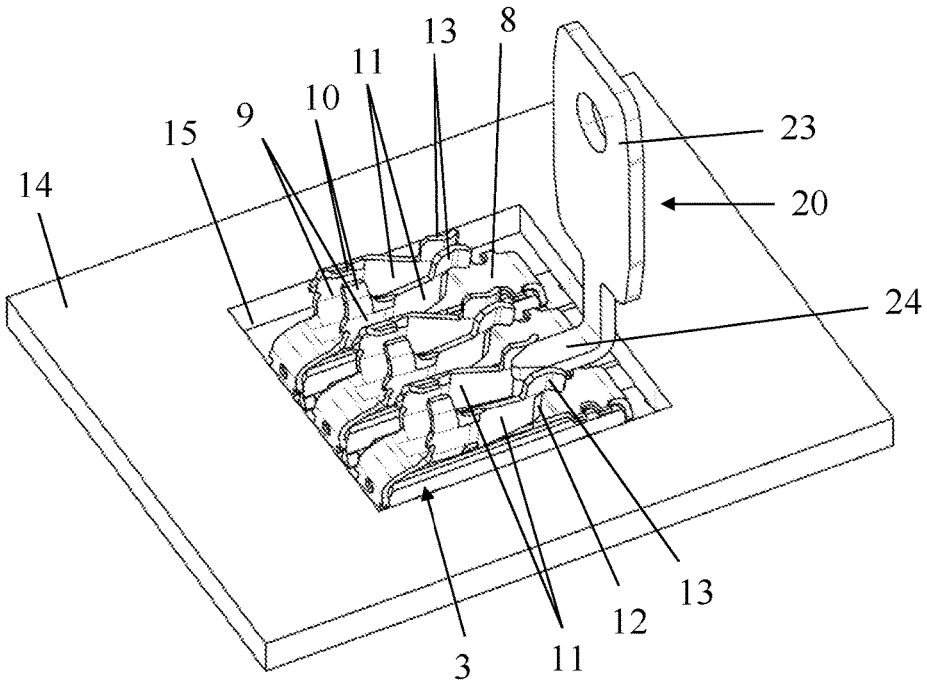
FIG. 7 is a perspective view of the conductor terminal from FIG. 6 with an actuating tool inserted between actuating tabs of the spring-force terminal connection.

FIG. 7 shows the arrangement from FIG. 6 with a printed circuit board 14 and therein, spring-force terminal connections 3 inserted into a receiving opening. The actuating tool 20 is now inserted in such a way in the front right-side spring-force terminal connection that the actuating finger 24 is positioned between the actuating tabs 13. This way, the two opposite leaf springs 11 of the spring-force terminal connection 3 are moved away from each other so as to open the clamping point formed at the mutually oppositely disposed clamping edges 12 for clamping an electric conductor. It is clear that the actuating finger 24 lies on a plane above the clamping plane formed by the leaf springs 11 for clamping an electric conductor. It is further clear that the actuating finger 24 is moved in a direction which substantially corresponds to the extension direction of the leaf springs 11, and is approximately parallel to the surface of the circuit board 14.

Figure 8:
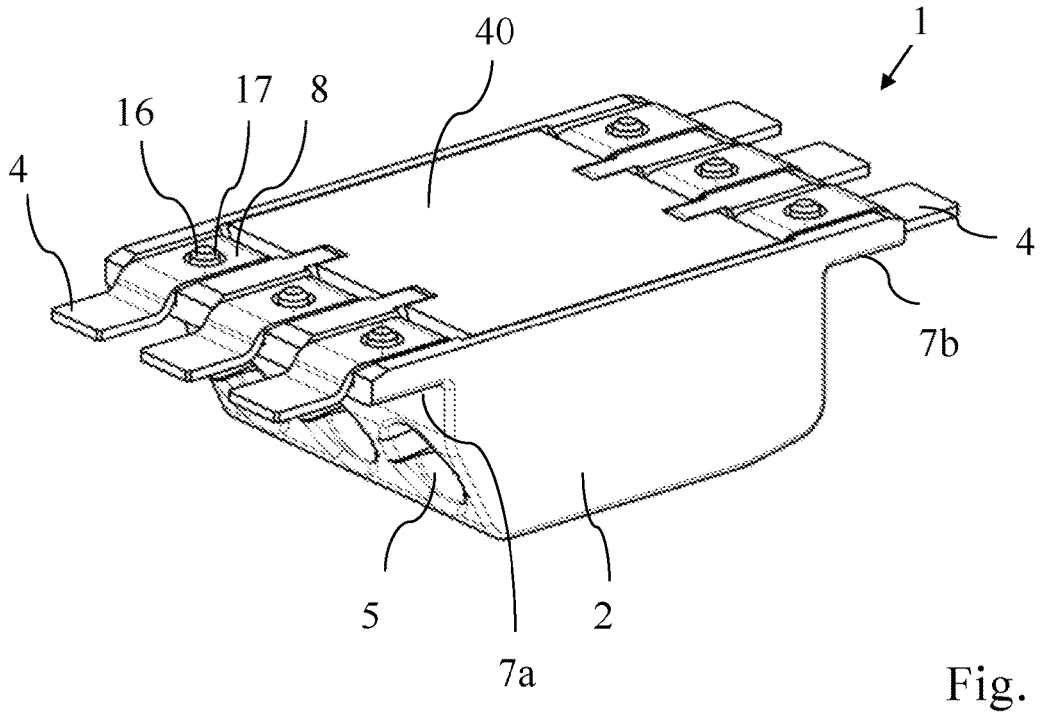
FIG. 8 is a perspective view of the conductor terminal from FIG. 1, obliquely from the rear side and from below.

FIG. 8 reveals a perspective rear side view of the conductor terminal 1. Here, it is again clear that the insulating material housing 2 is fixed in position with protrusions 16 in bearing openings 17 of the base portion 8 of a spring-force terminal connection 3. It is also apparent that the solder terminal contacts 4 are bent around onto the support plane of the bottom bases 7*a*, 7*b* of the insulating material housing 2.

Figure 9:
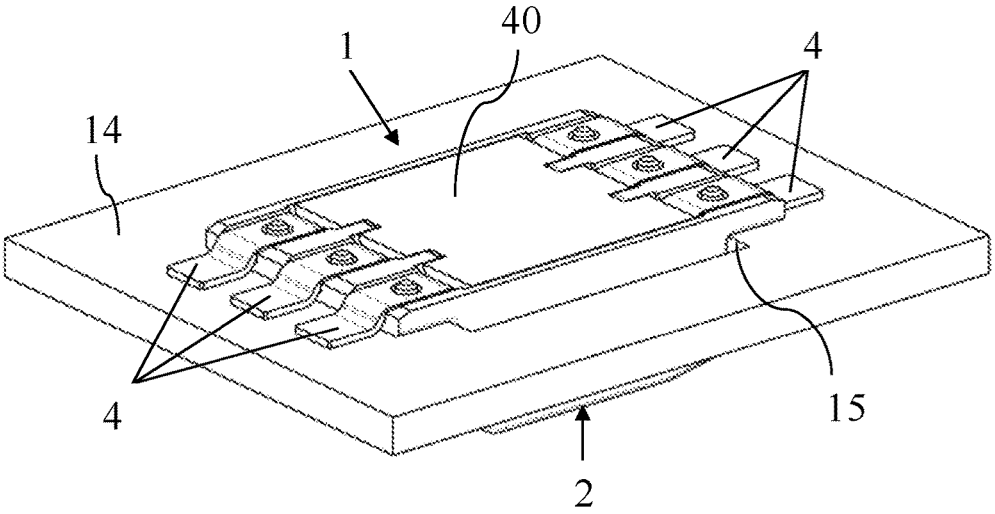
FIG. 9 is a perspective rear side view of the conductor terminal inserted in a circuit board and soldered thereto.

FIG. 9 shows a view of the conductor terminal 1 from FIG. 8 in the assembled state, wherein the conductor terminal 1 is inserted from the back into a receiving opening 15 of the circuit board 14. It is clear that the solder terminal contacts 4 now rest on the surface of the back of the circuit board 14 to be soldered there to the circuit board 14 by means of surface solder mounting.

Due to the fact that the actuating opening mandatorily reduces the actuating force to an actuating force acting approximately parallel to the surface of the printed circuit board 14, the solder terminal contacts 4 or the local solder connections with the circuit board 14 are only loaded with shear forces.

Here, again, the closure cover 40 can be seen, which closes the indented sections of the base portion 8.

Figure 10:
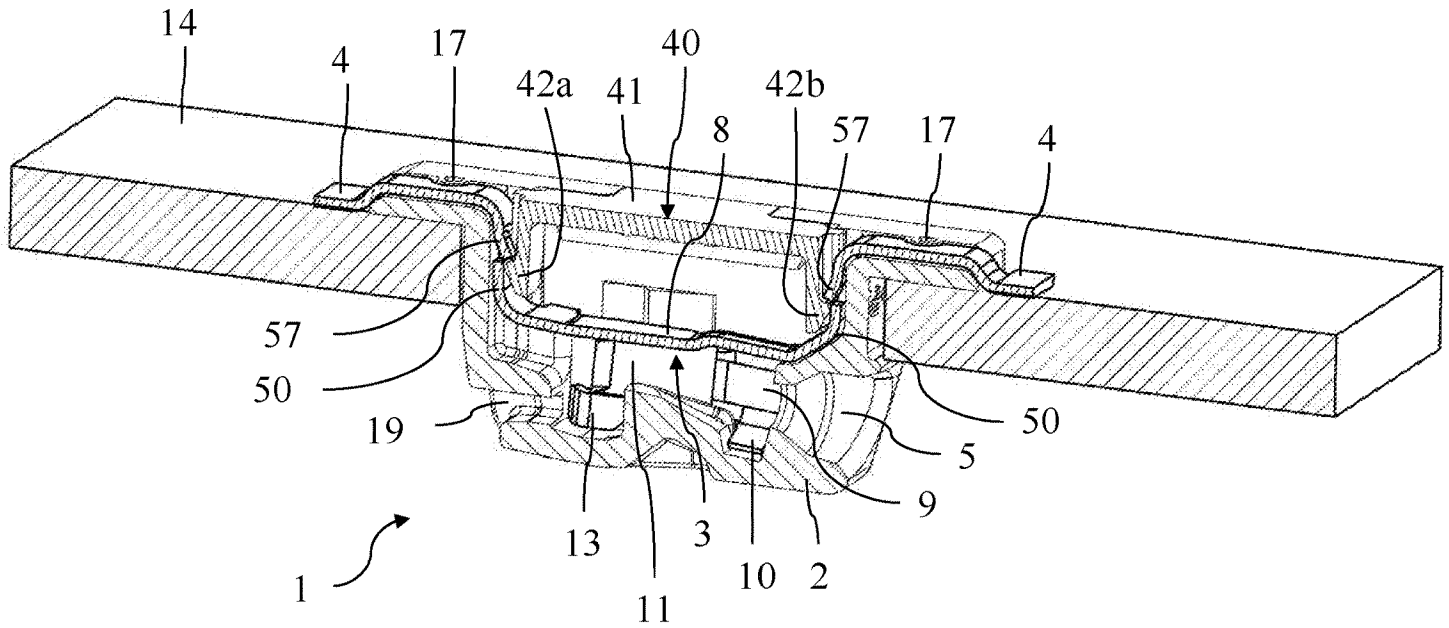
FIG. 10 is a side sectional view through an exemplary embodiment of a conductor terminal with a closure cover.

FIG. 10 shows a side sectional view through an exemplary embodiment of a circuit terminal 1 in a state in which it is inserted into a printed circuit board 14. The spring-force terminal connection 3 of the conductor terminal 1 has, as in the exemplary embodiment, a contact body shaped from a sheet element having a bottom section 8, spaced-apart lateral wall portions 9 protruding from the base portion 8, and solder terminal contact tongues 4. The solder terminal contact tongues 4 are bent out of the plane of the base portion 8, to which the leaf spring tongues 11 connect, and define a solder connection plane which is offset to the plane of the base portion 8. It is clear that the conductor terminal 1 is in turn inserted into an opening of the printed circuit board 14 so that the solder connection plane having the solder connection contact tongues 4 is disposed on the side of the circuit board 14 which is opposite the conductor insertion side comprising the conductor insertion opening 5.

Due to this plane offset, a clearance is provided for latching a closure cover 40.

The closure cover 40 has fingers 42*a*, 42*b* protruding perpendicularly or substantially perpendicularly from the cover plate 41 of the closure cover. The pair of such fingers 42*a*, 42*b* are mutually spaced apart and arranged opposite one another. These fingers 42*a*, 42*b* are adapted to the spring-force terminal connection 3 in such a way as to be immersed in the indented region of the spring-force terminal connection 3 and to rest against the connecting webs 50 which connect the base portion 8 with the contact tongues 4. The connecting webs 50 delimit the indented region and are aligned transverse to the plane of the base portion 8 and the plane defined by the solder terminal contact tongues 4.

It can be seen that latching tabs 57 are formed on the connecting webs 50, which together with a latching contour of the respective adjacent finger 42*a*, 42*b* form a stop for latching the closure cover 40 to the spring-force terminal connection 30. In the illustrated embodiment, the latching tabs 57 are formed of the sheet material of the spring-force terminal connection 3. To this end, flaps of material are cut from the sheet material and obliquely protrude out of the plane of the connecting webs 50.

Figure 11:
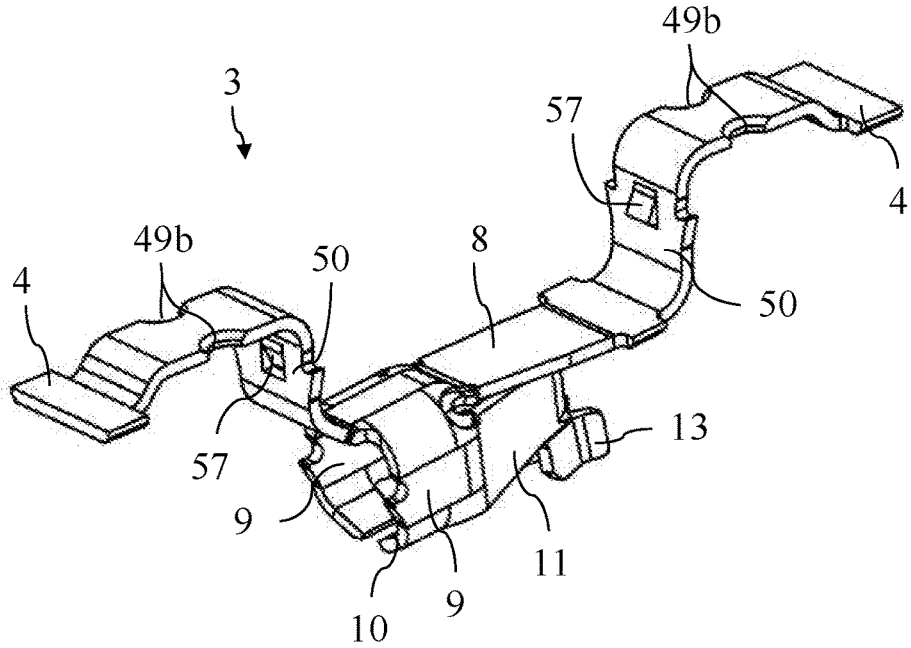
FIG. 11 is a perspective view of the basic construction of the spring-force terminal connection for the conductor terminal from FIG. 10.

This is more clearly seen in FIG. 11. FIG. 11 shows a perspective view of the basic construction of the spring-force terminal connection 3 from the underside. Here, reference may essentially be made to the description of the spring-force terminal connection in FIG. 2. For latching the closure cover 40, however, this embodiment does not provide any latching openings, but instead provides latching tabs 57 in the form of material flaps obliquely protruding out of the plane of the connecting webs 50. These constitute a stop for the latching contour of the closure cover 40.

Figure 12:
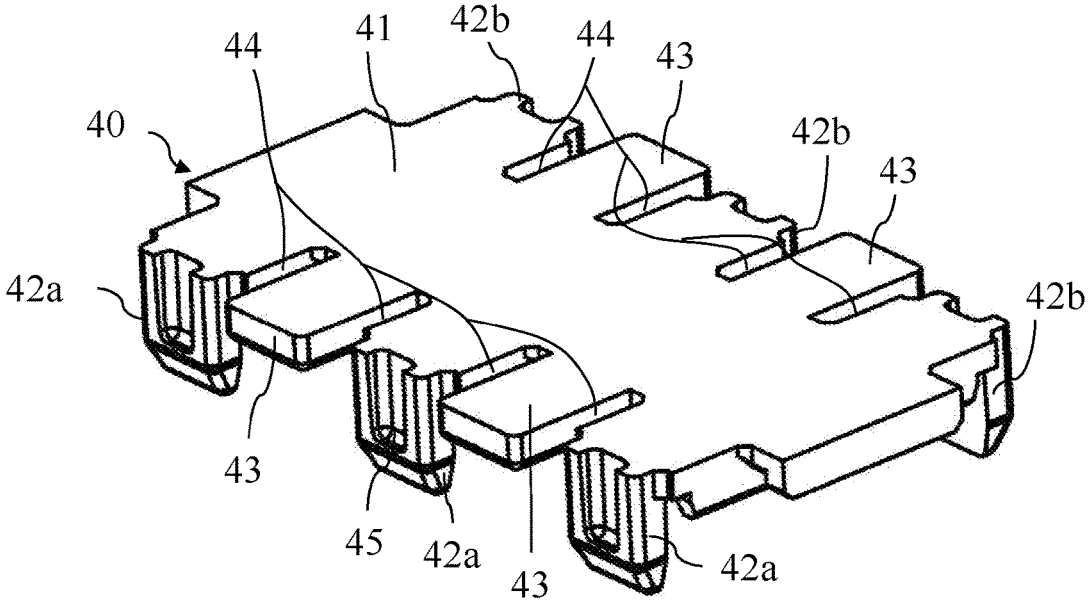
FIG. 12 is a perspective view of the closure cover of the spring-force terminal connection from FIG. 10.

FIG. 12 shows a perspective view of the closure cover 40 of the spring-force terminal connection 3 in FIG. 10. It is clear that for each spring-force terminal connection 3, in each case a pair of opposing fingers 42*a*, 42*b* are spaced from each other. These fingers 42*a*, 42*b* protrude transversely from the plane of the cover plate 41. In this embodiment, the latching contour of the fingers 42*a*, 42*b* for latching with the latching tabs 57 is carried out by a respective depression 45 which is incorporated in a finger 42*a*, 42*b*. For latching with a protruding latching tab 57 of the spring-force terminal connection 3, the latching contour must have a stop surface, which does not necessarily have to have a depression 45, the stop surface interacting with the latching tab 57.

Further, it can be seen that in each case between two adjacent fingers 42*a* or 42*b*, cover tongues 43 of the cover plate 41 are provided, which protrude on the plane of the cover plate 41 and are free from the portions of the cover plate 41 which transition into the fingers 42*a*, 42*b* by means of slots 44. These slots 44 serve to receive portions of the walls of the insulating material housing 2 and contribute to an increase in the clearance and creepage distances between the spring-force terminal connection 3 and the outer side, and thus to an improved electrical insulation.

Figure 13:
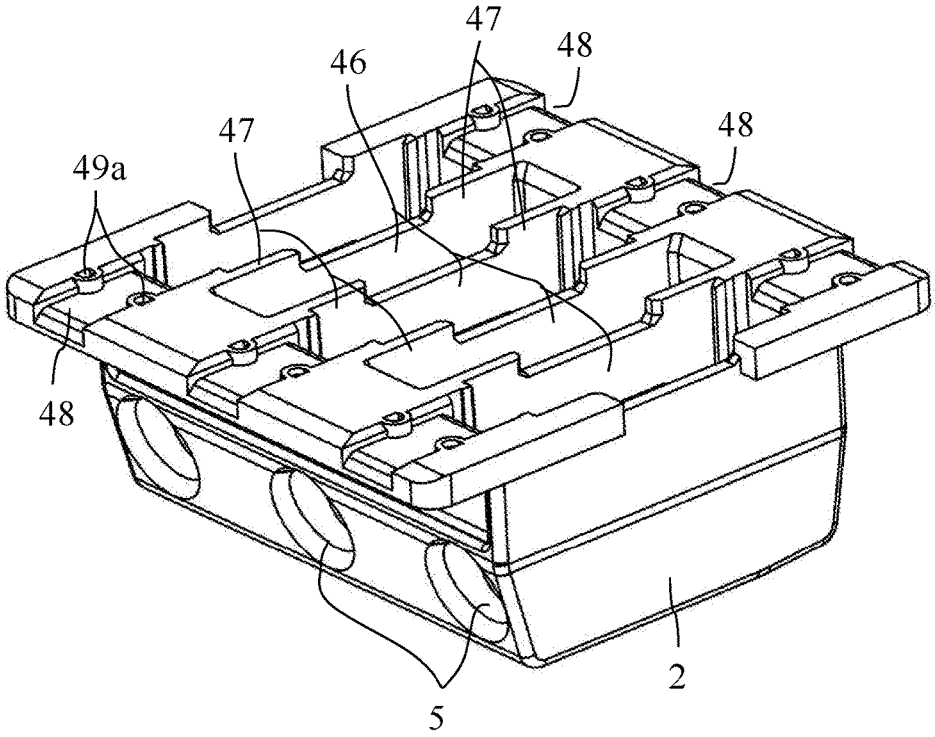
FIG. 13 is a perspective view of the underside of the insulating material housing of the conductor terminal from FIG. 10.

FIG. 13 shows a perspective view of the underside of the insulating material housing 2. It can be seen that this insulating material housing 2 is divided into chambers by partitions 46. In this case, receiving chambers spaced by an empty chamber for receiving a respective spring-force terminal connection are provided. The remaining web-like wall sections 47 at the top edge of the partitions 46 are provided for immersion in a respective associated slot 44 of the closure cover 40. The closure cover 40 is immersed in the indented portion of the partitions 46 to finish flush with the plane of the underside of the insulating material housing 2.

It can further be seen that the receiving chambers for the spring-force terminal connections 3 have recesses 48 towards the front and back sides through which the solder connection surfaces, i.e., the portions of the spring-force terminal connection 3 which adjoin the connecting webs 50, are immersed.

In the illustrated embodiment, locking protrusions 49*a* protrude 48 in on both sides of the recesses 48. As shown, these can be partially circular. Other shapes are conceivable. A spring-force terminal connection 3 inserted into a receiving chamber is held in position with these locking protrusions 49*a*. For this purpose, the spring-force terminal connections 3 have corresponding locking indentations 49*b* as illustrated in FIG. 11, into which the locking protrusions 49*a* are immersed.

Figure 14:
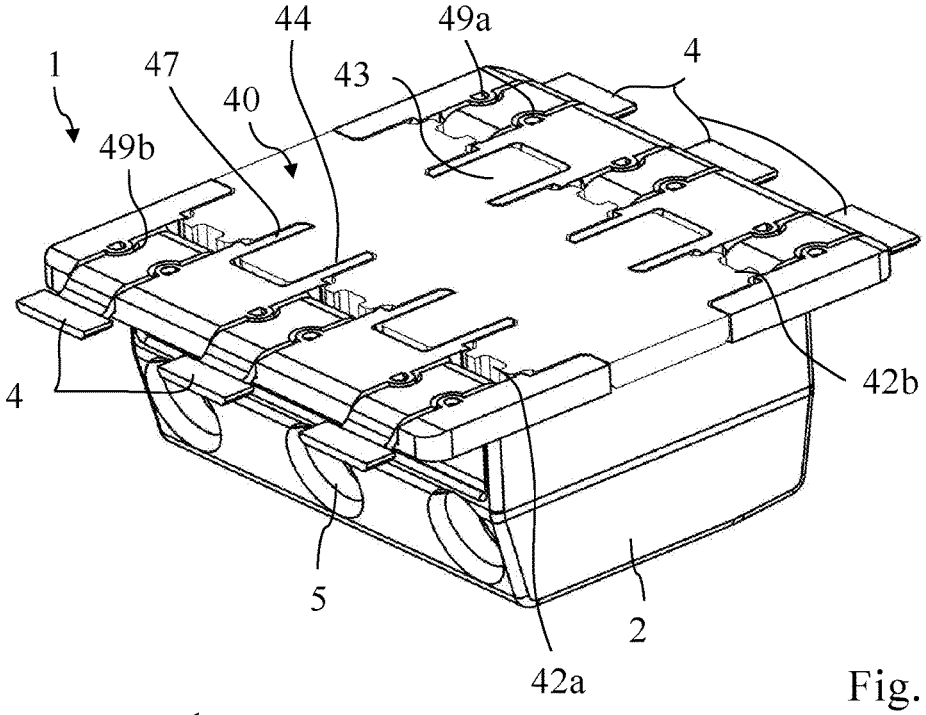
FIG. 14 is a perspective view of the underside of the conductor terminal in FIG. 10 with a closure cover.

FIG. 14 shows a perspective view of the exemplary embodiment of the conductor terminal 1 from underneath. The insulating material housing 2 is fitted with spring-force terminal connections 3 whose solder connection surfaces protrude from the insulating material housing 2. It is clear that the closure cover 40 is inserted flush into recesses of the insulating material housing 2 so that the fingers 42*a*, 42*b* protrude into the indented region of the spring-force terminal connections 3, interlocking there with the spring-force terminal connections 3.

It is also apparent that the cover tongues 43 and the intermediate chambers covered by the web-like wall portions 47 protrude into the slots 44 between, in each case, a covering tongue 43 and into a portion of the cover plate 41, which transition into a finger 42*a*, 42*b*. This way, the closure cover 40 is fixed in position and the clearance and creepage distances are optimized.

Figure 15:
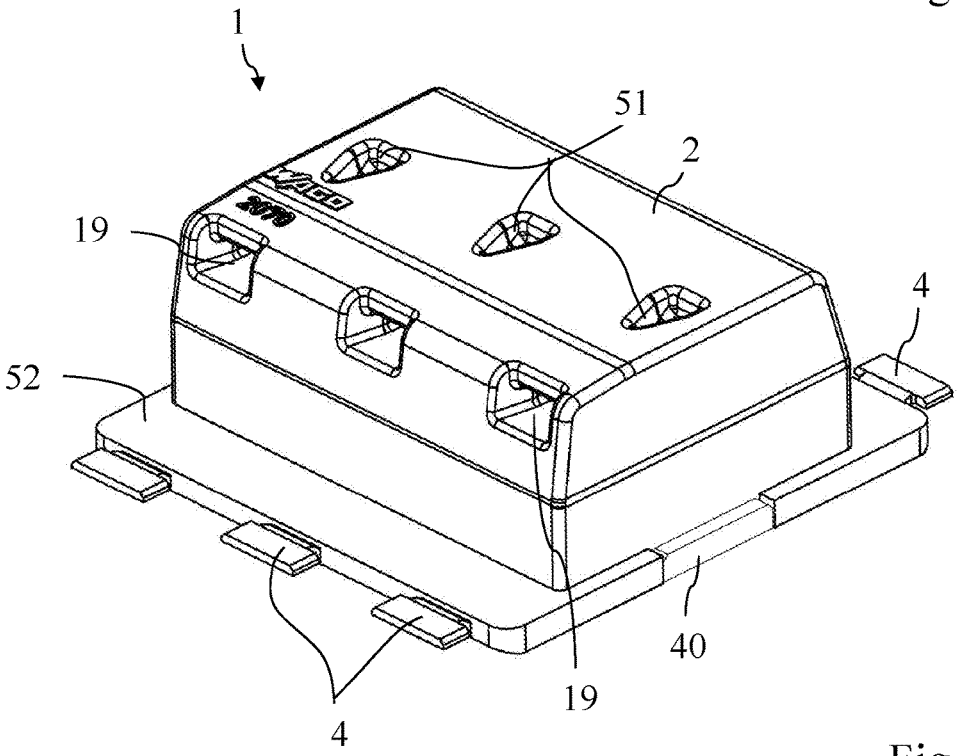
FIG. 15 is a perspective rear side view of the conductor terminal from FIG. 14 with a view of the top.

FIG. 15 shows a perspective view of the conductor terminal 1 in FIG. 14 from the upper side with a view to the back. Actuating openings 19 are provided at the back, leading to the actuating tabs 13 of a spring-force terminal connection 3.

Test openings 51 are optionally incorporated at the top of the insulating material housing 2. Test pins can be introduced into the test openings 51 to measure the electrical potential present at a spring-force terminal connection 3. It is also conceivable that the test openings 51 are used as actuating openings.

Furthermore, it is clear that the insulating material housing 2 has a collar 52, in particular on the front and back sides. This collar 52 is provided for bearing on the underside of a circuit board to place the conductor terminal 1 on a circuit board and to reduce as much as possible the forces acting with the circuit board on the solder joints at the solder connection surfaces.

Figure 16:
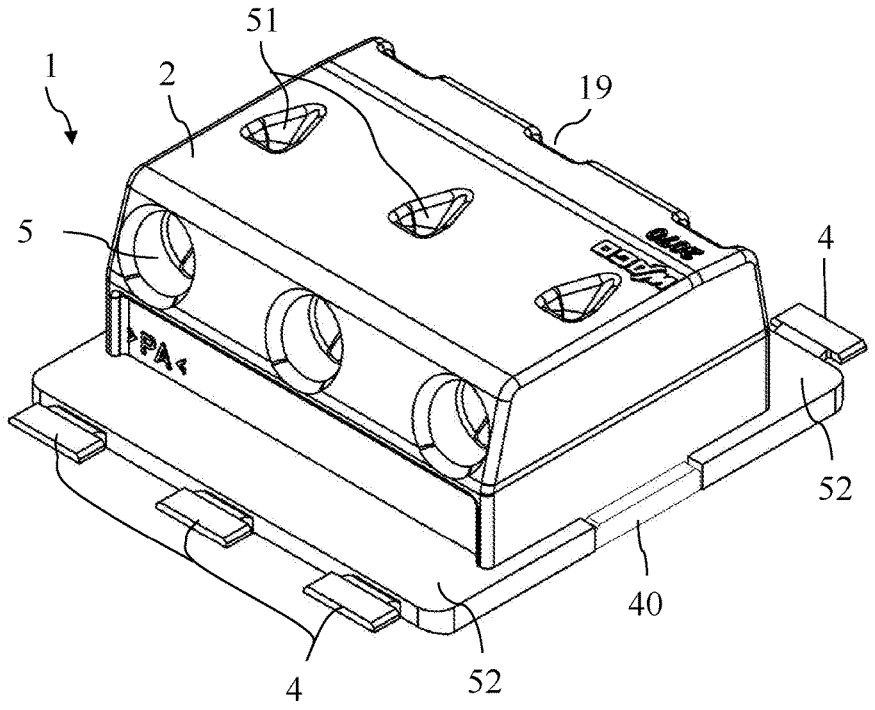
FIG. 16 is a perspective front side view of the conductor terminal from FIG. 15.

FIG. 16 shows the conductor terminal 1 in FIG. 15 from the front. It can be seen that the conductor insertion openings 5 are incorporated at the front.

As in FIG. 15, it also becomes clear here that the closure cover 40 transitions flush into the collar 52 of the insulating material housing 2 so that together with the closure cover 40, the collar 52 covers the insulating material housing 2 on the underside.

Figure 17:
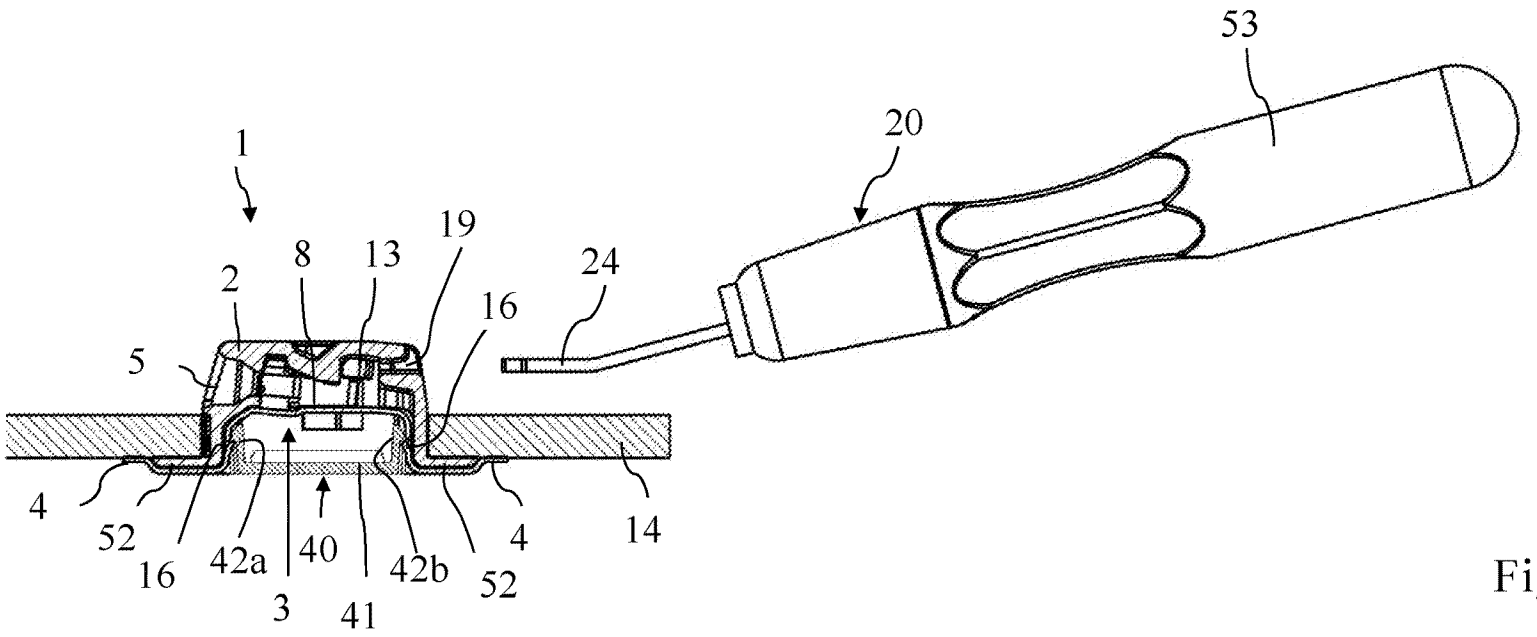
FIG. 17 is a side sectional view of the conductor terminal from FIGS. 10 to 16 with an additional actuating tool.

FIG. 17 shows the conductor terminal 1 in FIG. 10 with an additional actuating tool 20 in the side sectional view. The actuating tool 20 has a handle portion 53, from which an actuating finger 24 protrudes. The actuating finger 24 is formed as a plate or a rod-shaped element with a round or preferably angular cross section and is adapted to be inserted into an actuating opening 19. The actuating finger 24 then arrives between two actuating tabs 13 of a spring-force terminal connection 3 to press apart the leaf spring tongues 11 that are each connected with a pair of actuating tabs 13, and to thus open the clamping point formed by the leaf spring tongues 11 for clamping an electric conductor.

Incidentally, reference may be made to the statements regarding FIG. 10. It is clear in any case that the underside of the conductor terminal 1 is covered by the closure cover 40.

Figure 18:
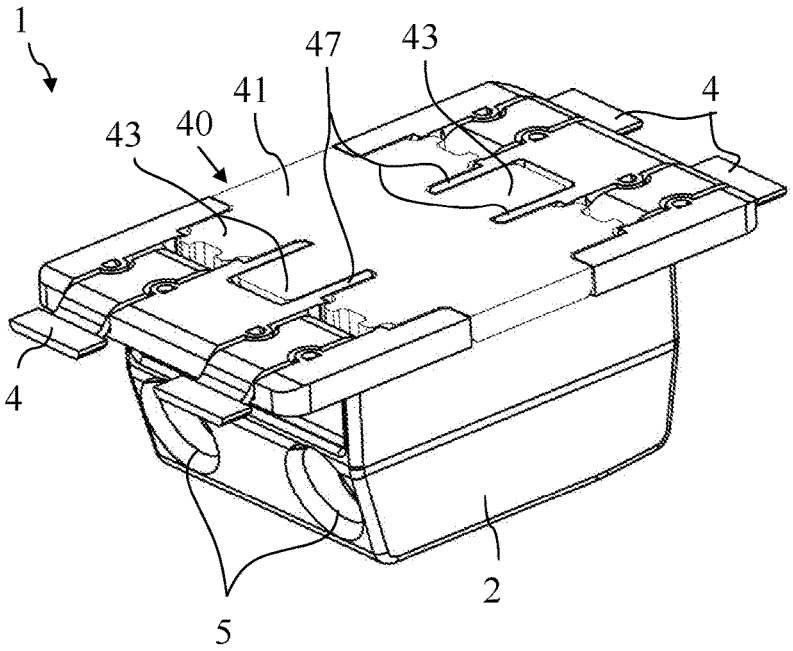
FIG. 18 is a perspective view of a two-pole conductor terminal according to the exemplary embodiment shown in FIG. 10.

FIG. 18 shows the exemplary embodiment of the conductor terminal 1 according to FIG. 14, now a two-pole embodiment. Here, reference can essentially be made to the statements pertaining to FIG. 14. In this two-pole conductor terminal 1, two spring-force terminal connections 3 are provided in the insulating material housing 2, which are spatially separated from each other by an intermediate chamber, each with associated conductor insertion openings 5.

Figure 19:
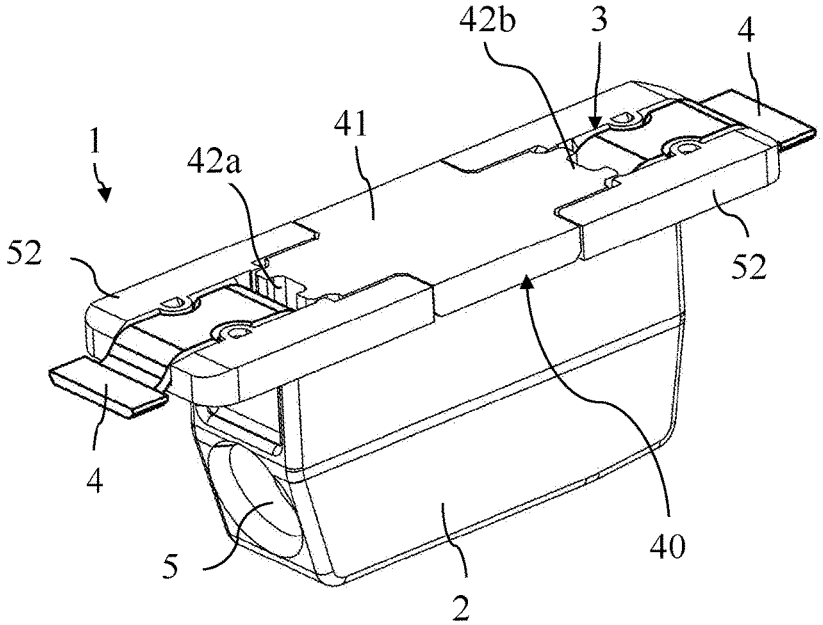
FIG. 19 is a perspective rear view of a single-pole conductor terminal of the exemplary embodiment according to FIG. 10.

FIG. 19 shows an embodiment of the single-pole version of this conductor terminal 1. In this case, only a single spring-force terminal connection 3 is present, which is immersed in a receiving opening of the insulating material housing 2, which is covered by the closure cover 40.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor terminal comprising:

an insulating material housing;

a spring-force terminal connection having a contact body shaped from a sheet element with a base portion, lateral wall portions protruding from the base portion and spaced apart from one another, and solder connection contact tongues, a conductor receiving channel formed by the base portion with the lateral wall portions, the conductor receiving channel adapted to receive an electric conductor;

at least one leaf spring tongue that has a clamping edge for clamping the electric conductor that is received in the conductor receiving channel, the at least one leaf spring tongue protruding from the lateral wall portions; and a conductor insertion opening formed on a front side of the insulating material housing that leads towards the conductor receiving channel, wherein the solder connection contact tongues are bent out of a plane of the base portion, and open up a solder connection plane that is arranged offset to the base portion and form an indented region of the base portion, and wherein a closure cover is provided to latch into the indented region.

2. The conductor terminal according to claim 1, wherein the closure cover has latching tabs that are adapted to latch into latching openings in the contact body.

3. The conductor terminal according to claim 1, wherein the closure cover has latching openings or latching edges that are adapted to latch with latching tabs of the contact body.

4. The conductor terminal according to claim 1, wherein the closure cover has fingers protruding substantially perpendicularly from a cover plate of the closure cover, wherein a pair of such fingers are arranged spaced apart and opposite each other and are adapted for immersion into the indented region for abutment adjacent against a connecting web of the contact body that leads from the base portion to a solder connection contact tongue.

5. The conductor terminal according to claim 4, wherein the fingers each have a latching contour, wherein the latching contours are each formed to latch with a latching tab of the contact body.

6. The conductor terminal according to claim 4, wherein the fingers each have a latching tab which is formed to latch into a latching opening of a respective adjacent connecting web of the contact body.

7. The conductor terminal according to claim 4, wherein, between two juxtaposed fingers of the closure cover, cover tongues of the cover plate protrude on the plane of the cover plate, wherein the cover tongues remain free via slots in the portions of the cover plate that transition into the fingers.

8. The conductor terminal according to claim 1, wherein the cover portion of the insulating material housing, which is situated opposite the base portion, is completely closed on a side of the spring-force terminal connection facing upwards away from the base portion in a region adjacent to the lateral wall portions and the leaf spring tongues of the contact body, wherein actuating tabs protrude from the leaf spring tongues facing away from the base portion, wherein the insulating material housing has on a back side an actuating opening leading towards the actuating tabs, which is situated opposite the conductor insertion opening, and wherein the actuating opening is delimited by the cover portion of the insulating material housing to form a guide channel.

9. The conductor terminal according to claim 8, wherein the guide channel of the actuating opening is formed by the cover portion by spaced-apart lateral portions of the inner wall of the insulating material housing and by a cover portion and the opposing socket portions.

10. The conductor terminal according to claim 9, wherein, in forming a conductor receiving pocket, the socket portion is spaced apart from the base portion of the spring-force terminal connection.

11. The conductor terminal according to claim 8, wherein the guide channel ends immediately upstream of the actuating tabs.

12. The conductor terminal according to claim 8, wherein the actuating opening extends from the back to the front side through the insulating material housing and opens out at the front side, adjacent to the conductor insertion opening.

13. The conductor terminal according to claim 12, wherein an actuating element is slidably accommodated in the actuating opening, wherein the actuating element has a protruding actuating portion that is designed for the application of force on the actuating tabs to open the clamping point formed by the clamping edges.

14. The conductor terminal according to claim 13, wherein the actuating element has a head portion that is accessible from the back side of the insulating material housing for applying the force, and a signal portion that protrudes from the front side of the insulating material housing when the spring-force terminal connection is in an open state.

15. An assembly comprising:

a conductor terminal according to claim 8; and an actuating tool having a holding portion and an actuating finger for insertion into the actuating opening and for pushing apart the actuating tabs to open a clamping point.

16. The assembly according to claim 15, wherein the holding portion and the actuating finger are at an angle to each other.

17. The assembly according to claim 15, wherein, on the holding portion, at least two juxtaposed and spaced-apart actuating fingers are provided for insertion into a respective associated actuating opening of at least two actuating openings of the insulating material housing of the conductor terminal.

18. The conductor terminal according to claim 1, wherein an indentation, which transitions into an actuating opening, is arranged on the cover portion in a back region of the insulating material housing, which is located opposite the conductor insertion opening.

19. The conductor terminal according to claim 1, wherein the insulating material housing has a plurality of juxtaposed conductor insertion openings, and wherein the conductor terminal has a plurality of spring-force terminal connections adjacently received in the insulating material housing and are associated with a respective conductor insertion opening.

* * * * *